US006780072B1

(12) United States Patent
de Almeida et al.

(10) Patent No.: US 6,780,072 B1
(45) Date of Patent: Aug. 24, 2004

(54) SUBSURFACE BUOY AND METHODS OF INSTALLING, TYING AND DYNAMICALLY STABILIZING THE SAME

(75) Inventors: Jose Carlos Lima de Almeida, Rio de Janeiro (BR); Ricardo Franciss, Rio de Janeiro (BR); Carlos Eduardo Costa Valle Longo, Rio de Janeiro (BR)

(73) Assignee: Petroleo Brasileiro S.A.-Petrobras, Rio De Janeiro (BR)

( * ) Notice: Subject to any disclaimer, the term of this patent is extended or adjusted under 35 U.S.C. 154(b) by 0 days.

(21) Appl. No.: 10/367,480

(22) Filed: Feb. 14, 2003

(51) Int. Cl.[7] ..... B63B 22/02
(52) U.S. Cl. ..... 441/4
(58) Field of Search ..... 441/3–5; 114/230.1

(56) References Cited

U.S. PATENT DOCUMENTS 4,423,984 A * 1/1984 Panicker et al. ..... 405/224.3
4,427,072 A * 1/1984 Lawson ..... 166/345
4,892,495 A * 1/1990 Svensen ..... 441/5
5,007,482 A * 4/1991 Forsyth et al. ..... 166/345
5,749,985 A * 5/1998 Sparks et al. ..... 156/64

FOREIGN PATENT DOCUMENTS

GB 2257405 1/1993

* cited by examiner

*Primary Examiner*—Stephen Avila
(74) *Attorney, Agent, or Firm*—Traskbritt

(57) ABSTRACT

The present invention relates to equipment installed in an intermediary region between a floating production unit at the ocean surface and a wellhead of an oil reservoir on the ocean floor. The equipment, known as a subsurface buoy, is designed to support rigid and flexible production tubes used for the transport of reservoir fluids from the oil well and/or fluids used in support systems for the oil reservoir. Four cylindrical bodies 1, 2, 3, and 4, connected at their extremities, form the body of the subsurface buoy. In each of the vertices of the subsurface buoy, components of a tying and dynamically stabilizing system 13 are rigidly connected. This tying and dynamically stabilizing system 13 is configured to control the positioning of the subsurface buoy, the tension of installation chains 15 and anchoring tendons 21, thereby promoting a stabilization of the entire assembly against large-amplitude rotations or angular changes even after rigid tubes 10 and flexible tubes 11 are coupled to the body of the subsurface buoy. In addition, a method to install the subsurface buoy is also presented.

6 Claims, 8 Drawing Sheets

SUBSURFACE BUOY AND METHODS OF INSTALLING, TYING AND DYNAMICALLY STABILIZING THE SAME

BACKGROUND OF THE INVENTION

1. Field of the Invention

The present invention relates to the field of oil-well equipment used in an intermediary region between a floating production unit at the ocean surface and a wellhead of an oil reservoir, or well, on the ocean floor. The equipment is designed to support rigid and flexible production tubes, or pipes, used for the transport of reservoir fluids from the oil well and/or fluids used in support systems for the oil reservoir. In addition, a method of installing the equipment at its designed operating depth is also disclosed.

2. State of the Art

Offshore exploration of hydrocarbons in deep or ultra-deep waters has always presented a technological challenge to companies involved in such an undertaking and represents a significant boundary, or limit, to applicable scientific knowledge. This challenge, when overcome, will take us to the forefront of this technology.

Given the large depths associated with deep-water exploration and, consequently, the exposure to a harsh environment, interconnection between the wellhead on the ocean floor and a flow system for extracting the oil production is a great technological challenge. In addition, the installation and support of ascending production tubes, also known as "risers" in a configuration known as suspended catenaries, adds to the technological challenge.

In the environment of ultra-deep water, it has been known that hybrid concepts, if not considered the only alternative due to limited field experience, should be evaluated with much care. This need of evaluation exists due to the use of flexible risers as an interconnection between the wellhead on the ocean floor and the production unit. Flexible risers in suspended-catenary configuration, i.e., a direct connection between the wellhead and the floating production unit for depths greater than 1000 meters, present dynamic problems caused by movement of the floating production unit itself. These movements may provoke a compression and/or excessive curvature at the location where the catenary, formed by the riser, contacts the ocean floor or creates an additional load at the top of the riser due to angular motion and/or horizontal displacement that may provoke rupture in the connections at the surface. In the case of the flowing unit being a Floating Production Storage and Offloading (FPSO) ship, the above mentioned problems exist in a much more critical scale.

Another type of riser which is used is a substantially rigid riser, known as Steel Catenary Riser (SCR). The use of SCRs, connected directly to the floating production units, has limitations, as far as their configuration when used in ships converted to production (FPSO), because the ship movements provoked by waves are more accentuated compared to semi-submersed platforms. SCRs may have desirable characteristics associated with the capacity to support, along their extremities, higher tension as compared to flexible risers; however, the flexible risers have longer life in terms of resisting fatigue even taking into account their interaction with ocean waves and currents.

It has been, therefore, proposed to combine the two types of risers in an assembly in order to take advantage of the best characteristics of each type: namely the resistance to tension and the higher economic viability associated with SCRs; and a significantly higher resistance to fatigue associated with flexible risers.

In an assembly, an intermediary system would be necessary, having sufficient floatation to support the weight of the rigid production tubes, while, at the same time, exhibiting only small displacements in response to the horizontal loading of SCRs and the environmental working loads. The system, or assembly, would also need to be submersed sufficiently to protect it from the effects of waves at the ocean surface, be capable to connect the SCR to the flexible riser, and be reasonably easy to install. With these necessary prerequisites, the concept of a subsurface buoy, or float, developed naturally, permitting a considerable reduction in the weight of the production tubes on the floating unit, improving undersea arrangement, and thus making possible the use of a hybrid system of risers.

Hybrid systems of risers, based in a subsurface buoy, have recently been recognized as an alternative to the limitations found in petroleum production activities in deep-sea water.

There exist in the art, and more specifically in the field of introduction and connection of production tubes, concepts of intermediary support systems to promote the connection between a vertical riser and flexible tubes or even concepts to reduce the loads on equipment and tubes.

Examples of these systems may be found in the documents BR/PI 9202379-A, belonging to Bechtel Limited, in which a system to deploy, or unfold, cable used at an intermediate floating level and the associated flexible rising tubes are disclosed. U.S. Pat. No. 4,423,984, assigned to Mobil Oil Corporation, discloses a way to interconnect the flexible tubes originating at a surface unit and a rigid vertical riser with a buoy connected at the upper extremity of the vertical riser. U.S. Pat. No. 5,007,482, assigned to British Petroleum Company, similarly discloses another concept to make the connection between the wellhead and a floating unit using a buoy as an intermediary support for the flexible tubes.

Although the inventions just summarized may appear as viable solutions, they may become problematic when considering their economic viability, installation difficulties, and behavior when exposed to the harsh environmental conditions such as, for example, the effect of the waves.

SUMMARY OF THE INVENTION

The present invention relates to equipment designed to support and interconnect rigid and flexible tubes used in the production and transport of oil from an underwater well and/or fluids used in support systems for the reservoir. Such equipment is usually known as a subsurface buoy. A system to tie and to dynamically stabilize the buoy is also in the scope of the present invention. Additionally, a method is also disclosed to install the subsurface buoy at its location of operation.

The subsurface buoy, one of the objects of the present invention, comprises four interconnecting cylindrical units forming a single unit, each one of these cylindrical units having in its interior a plurality of draining compartments for the purpose of ballasting. Such a floating body resembles a quadrilateral frame defining a whole therethrough, having a plurality of fixed connections for interconnecting the rigid and flexible tubes thereto. A tying and dynamically stabilizing system, rigidly connected at each of the vertices of the subsurface buoy, is another object of the present invention. The tying and dynamically stabilizing system is designed to control the float position and the traction and the tension in the anchoring tendons, providing stabilization for the entire unit against large-amplitude rotation or changes in angular position even after the rigid and flexible tubes are couple or connected to the floating body, or buoy. Hereinafter, chained sections formed by links will be referred to as "chains" and steel or polyester cables will be designated as "tendons."

Another object of the present invention is a method of installation of the subsurface buoy at its operating location with the fluid transport tubes connected thereto and the use of a system to tie and dynamically stabilize the subsurface float.

BRIEF SUMMARY OF THE DRAWINGS

The characteristics of the subsurface buoy, of the tying and dynamically stabilizing system, and of the method of installation of the subsurface buoy, all objects of the present invention, will be better understood by the detailed description to be later presented, as a mere example, together with the drawings summarized below, which drawings are integral with the present application and comprise.

DETAILED DESCRIPTION OF THE INVENTION

The detailed description of the subsurface buoy, the tying and dynamically stabilizing system, and the method of installation of the subsurface buoy, all being objects of the present invention, will be presented utilizing the identification of the respective components as illustrated in the above-summarized drawing figures.

Figure 1:
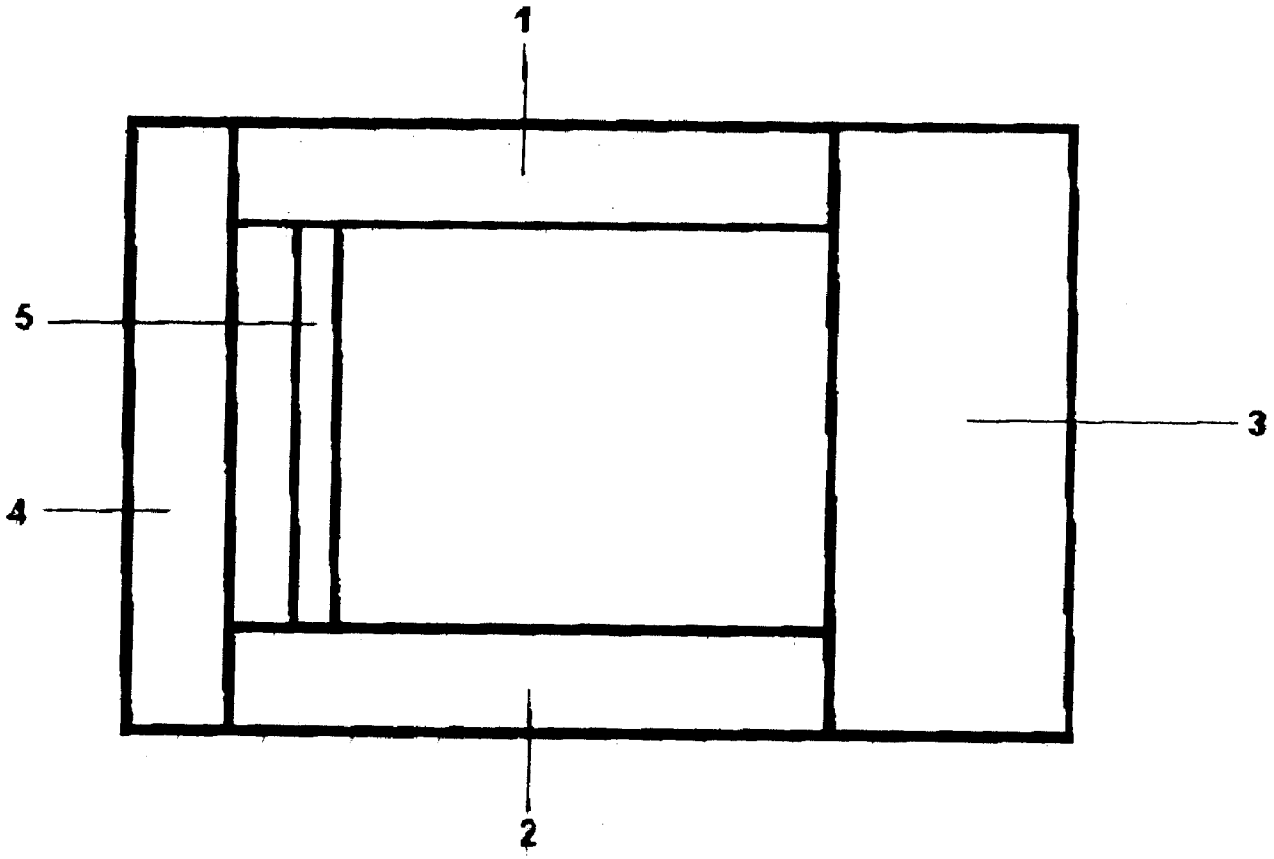
FIG. 1 illustrates schematically a top view of the subsurface buoy according to the present invention.

A top view schematically representing the subsurface buoy of the present invention is illustrated in FIG. 1. The subsurface buoy comprises four cylindrical bodies, a first cylindrical body 1 and a second cylindrical body 2, having equal lengths and diameters The first and second cylindrical bodies are positioned longitudinally parallel and separate relative to one another. In order to facilitate the description, the side of the subsurface buoy where the first cylindrical body 1 is located will be referred to as the "starboard side." Similarly, the side where the second cylindrical body 2 is located will be referred to as the "portside." To one of the extremities of the longitudinal cylindrical bodies 1 and 2, a third cylindrical body 3 is connected, in a transversal position, having a larger diameter than the other two cylindrical bodies. The other extremities of the longitudinal cylindrical bodies 1 and 2 are also connected transversally to a fourth cylindrical body 4, having a length equal to that of the third cylindrical body 3, and having a diameter equal to those of the longitudinal cylindrical bodies 1 and 2. The side of the subsurface buoy where the third cylindrical body 3 is located will be referred to hereinafter as the "stem side." Similarly, the side of the subsurface buoy where the forth cylindrical body 4 located it will be referred to as the "bow or nose side." The interconnection between the cylindrical bodies 1, 2, 3 and 4 forms the body of the subsurface buoy, giving it a quadrilateral appearance defining a hole therethrough. A descending stabilizer 5 in the form of a blade, for example, is connected by its extremities to the longitudinal cylindrical bodies 1 and 2 parallel to the fourth cylindrical body 4 and next to the bow side in order to stabilize the positioning of the subsurface buoy during the descending operation.

Figure 2:
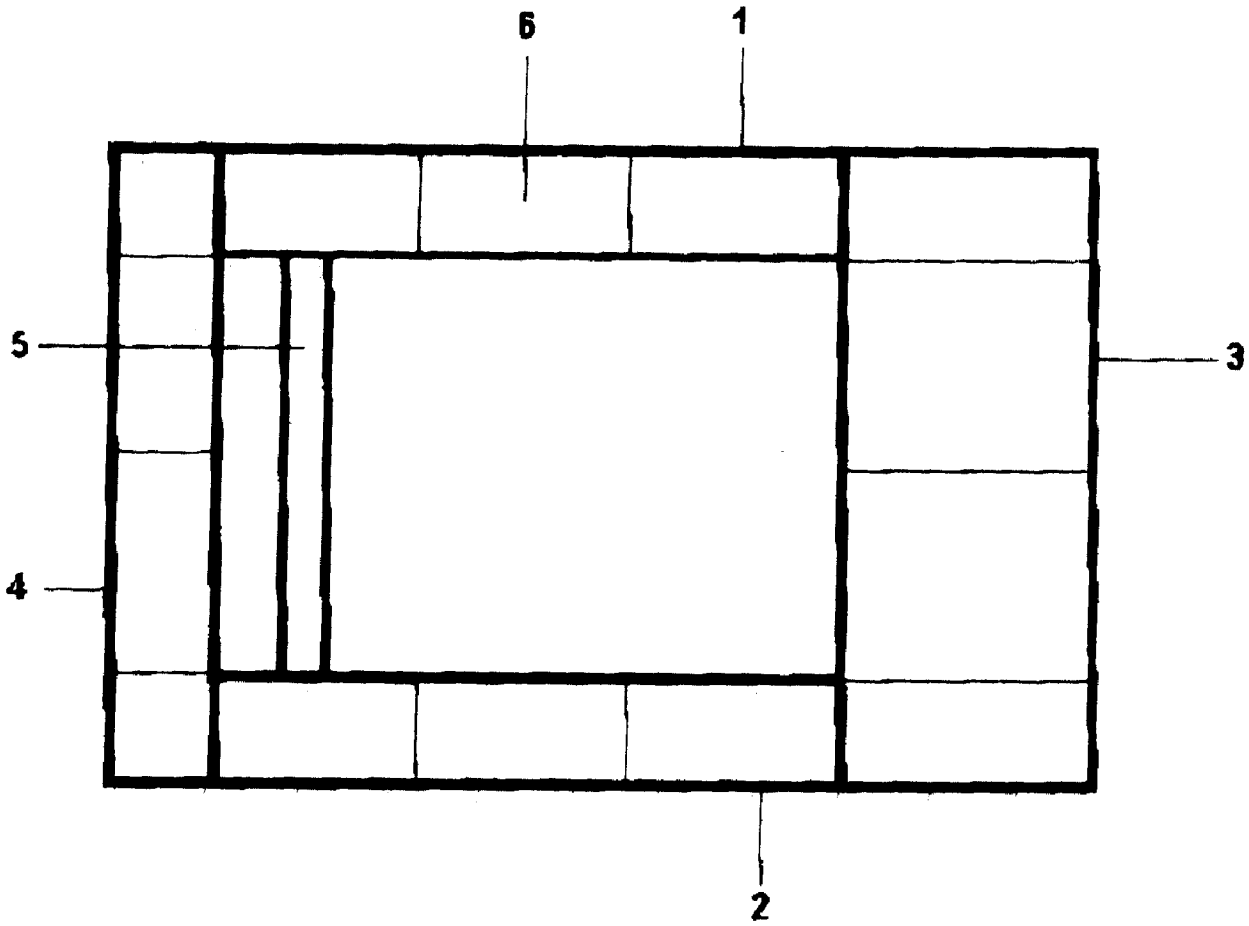
FIG. 2 illustrates schematically a longitudinal cut of the top view of the subsurface buoy of FIG. 1.
Figure 2A:
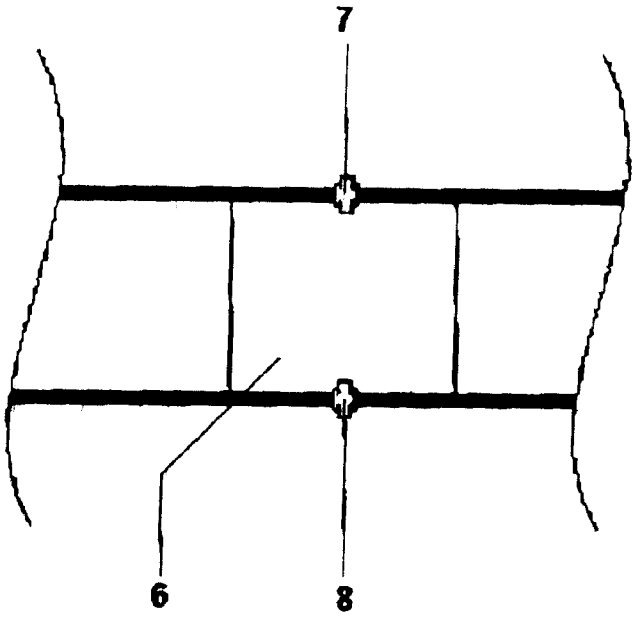
FIG. 2*a* illustrates schematically the details of a longitudinal cut of the ballast or draining compartments inside the cylindrical, or tubular, bodies that form the subsurface buoy of FIG. 1.

FIG. 2 illustrates a horizontal cut of a top view of the subsurface buoy of the present invention, wherein a plurality of draining compartments 6 are shown located internally in each of the cylindrical bodies 1, 2, 3, and 4. FIG. 2*a* schematically illustrates a longitudinal cut of anyone of the draining compartments 6 illustrated in FIG. 2. Connected to the top of each draining compartment 6 is a first valve 7 for the introduction or removal of compressed air. Toward the bottom of each draining compartment 6, a second valve 8 is connected for the ballasting purposes, allowing seawater in and out of each draining compartment 6.

Figure 3:
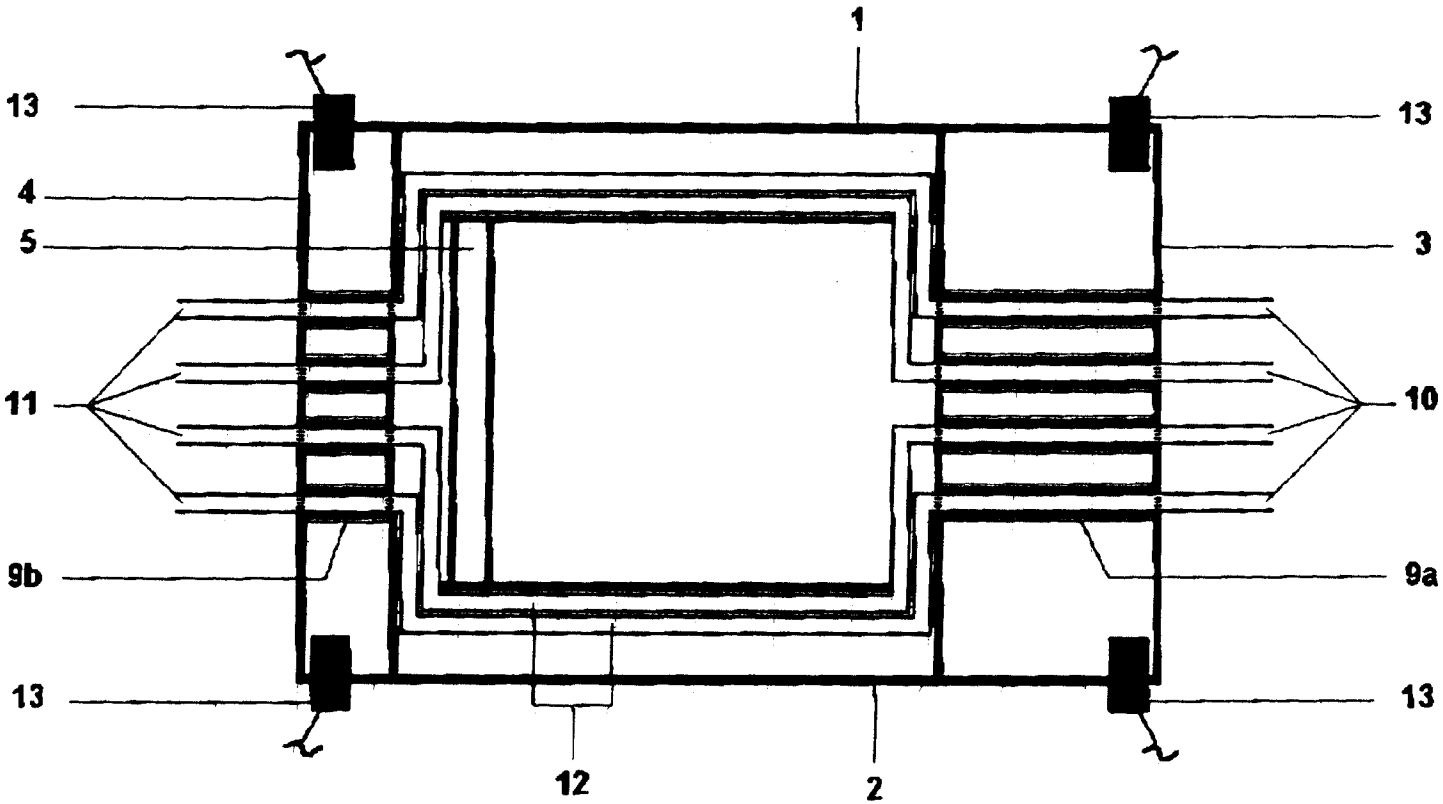
FIG. 3 illustrates schematically a top view of the subsurface buoy of FIG. 1 showing the rigid tubes, flexible tubes, intermediary tubes, and the tying and dynamically stabilizing system.

FIG. 3 illustrates the positioning of supports 9*a* and 9*b*, known in the art as "goose necks," that serve to support the two types of tubes used in the transport of oil from the ocean floor to the surface, namely rigid tubes 10 and flexible tubes 11. Supports 9*a* and 9*b* are fixed to the transversal cylindrical bodies 3 and 4, respectively. To the third cylindrical body 3, supports 9*a* are installed to which, at one of their extremities, rigid tubes, or "SCRs," are installed connecting the wellhead at the ocean floor to the subsurface buoy. Flexible tubes 11, or "Jumpers," are installed on one of the extremities of supports 9*b* installed to the fourth cylindrical body 4, connecting the subsurface buoy to the floating production unit. Intermediary tubes 12, being aligned to the longitudinal cylindrical bodies 1 and 2 and interconnected to the rigid tubes 10 and flexible tubes 11, are connected to the other extremities of supports 9*a* and 9*b*. At the vertices formed by the union of cylindrical bodies 1, 2, 3, and 4, fixation points for the tying and dynamically stabilizing system 13, also used to install the subsurface buoy at its depth of operation.

Figure 4:
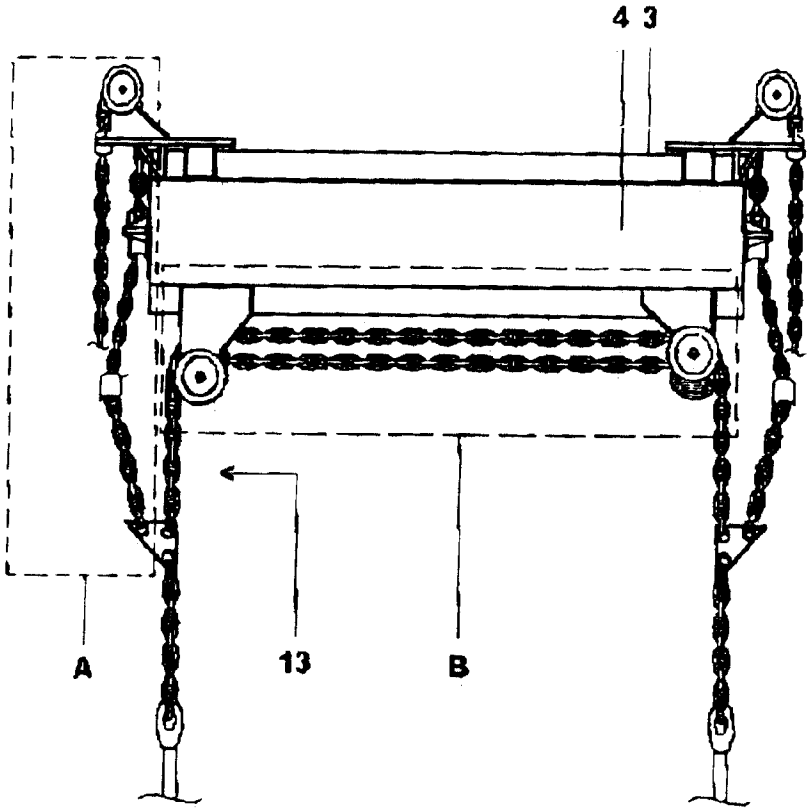
FIG. 4 illustrates a frontal view of the subsurface buoy of FIG. 1, detailing the tying and dynamically stabilizing system for the subsurface buoy of the present invention.

FIG. 4 illustrates in more detail the characteristics of the tying and dynamically stabilizing system 13, which comprises a passive system A and a tension equalization system B.

Figure 4A:
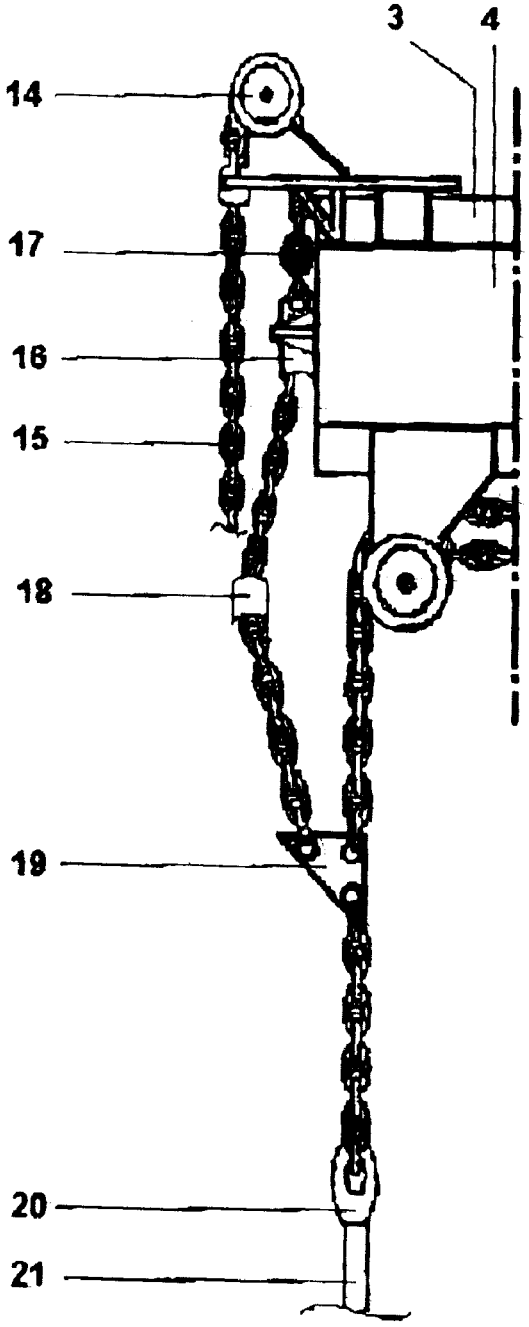
FIG. 4*a* illustrates a passive system, which is one of the integral parts of the tying and dynamically stabilizing system for the subsurface buoy of the present invention.

The passive system A is passive because it does not use any source of energy (electric, hydraulic, pneumatic, or otherwise) to operate, serving only to install the subsurface buoy at its place of operation. Each one of the passive systems A is rigidly connected to the vertices of the subsurface buoy located at the upper extremities and sides of cylindrical bodies 3 or 4. The details of passive systems A are illustrated in FIG. 4*a* and comprise:

pulleys, or runners, 14 connected to one of the upper extremities of the cylindrical bodies 3 or 4;

an installation chain, or cable, 15, passing over pulley 14, used as a counterweight during the float's descending operation to its depth of operation;

a chain stopper 16, through the interior of which the installation chain 15 passes, rigidly connected to the extremities of each one of the tubular, or cylindrical, bodies 3 and 4, and used to limit the travel of the installation chain 15 during the installation of the subsurface buoy;

an actuator link 17 for the chain stopper 16, interposed between links of the installation chain 15;

an end-of-travel device 18, interposed between links of the installation chain 15 and located below the chain stopper 16, used to interrupt or suspend the travel of the installation chain 15 during the installation of the subsurface buoy;

a coupling plate 19, joined to one of the ends of installation chain 15, used to connect the passive system A to the tension equalizing system B and to the anchoring tendon 21; and a lower connection 20, connecting the installation chain 15 to the anchoring tendon 21.

Figure 4B:
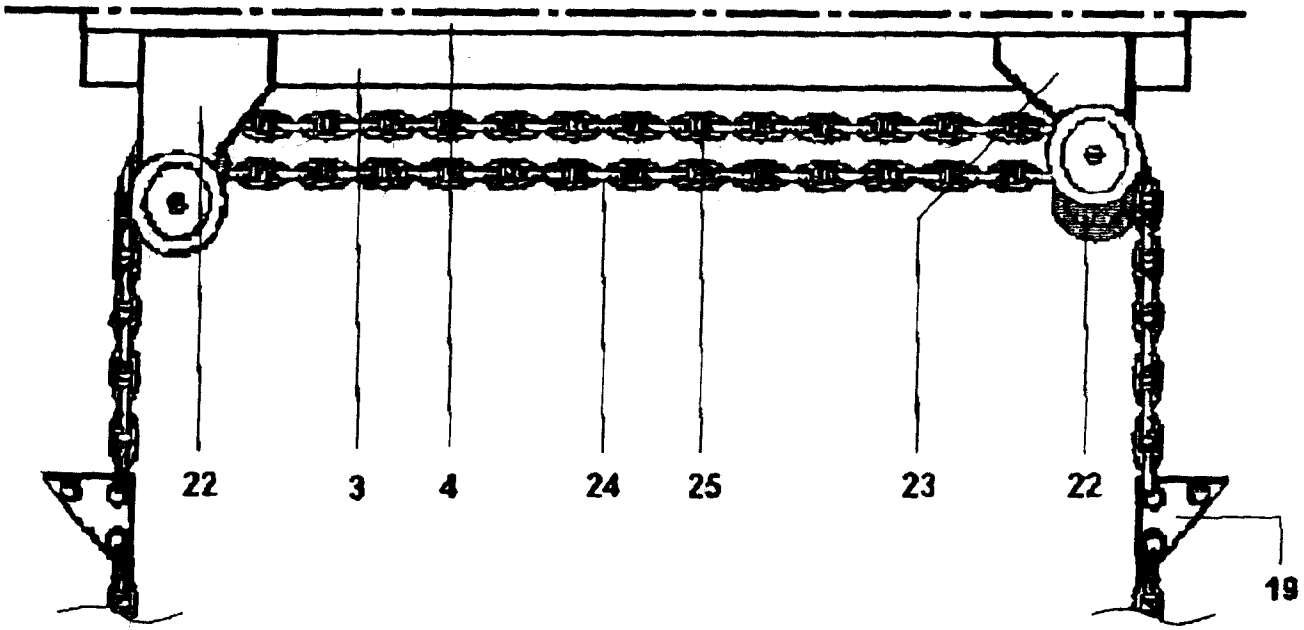
FIG. 4*b* illustrates a tension equalizing system, which is another integral part of the tying and dynamically stabilizing system for the subsurface buoy of the present invention.

The tension equalizing system B, after installation of the subsurface buoy at its operating position, is configured to maintain the tension in each anchoring tendon 21 equally distributed, connect the subsurface buoy to the ocean floor, and maintain the subsurface buoy in stable conditions, i.e., preventing unwanted variations in inclination caused by ocean currents or the weight of the tubes, or pipes, connected to the subsurface buoy. The details of tension equalizing system B are illustrated in FIG. 4*b* and comprise:

major-base pulleys 22 connected to lower extremities of the cylindrical bodies 3 and 4, one major-base pulley 22 being connected to one extremity of cylindrical body 3 and another to a diagonally opposed extremity of cylindrical body 4; minor-base pulleys 23 connected to the other lower extremities of the cylindrical bodies 3 and 4, one minor-base pulley 23 being connected to one extremity of cylindrical body 3 and another to a diagonally opposed extremity of cylindrical body 4;

a first supporting component 24, passing over the major-base pulleys 22, connected by its extremities to the diagonally opposed coupling plates 19 on the anchoring tendons 21; and a second supporting component 25, passing over the minor-base pulleys 23, connected by its extremities to the diagonally opposed coupling plates 19 on the anchoring tendons 21.

Figure 5:
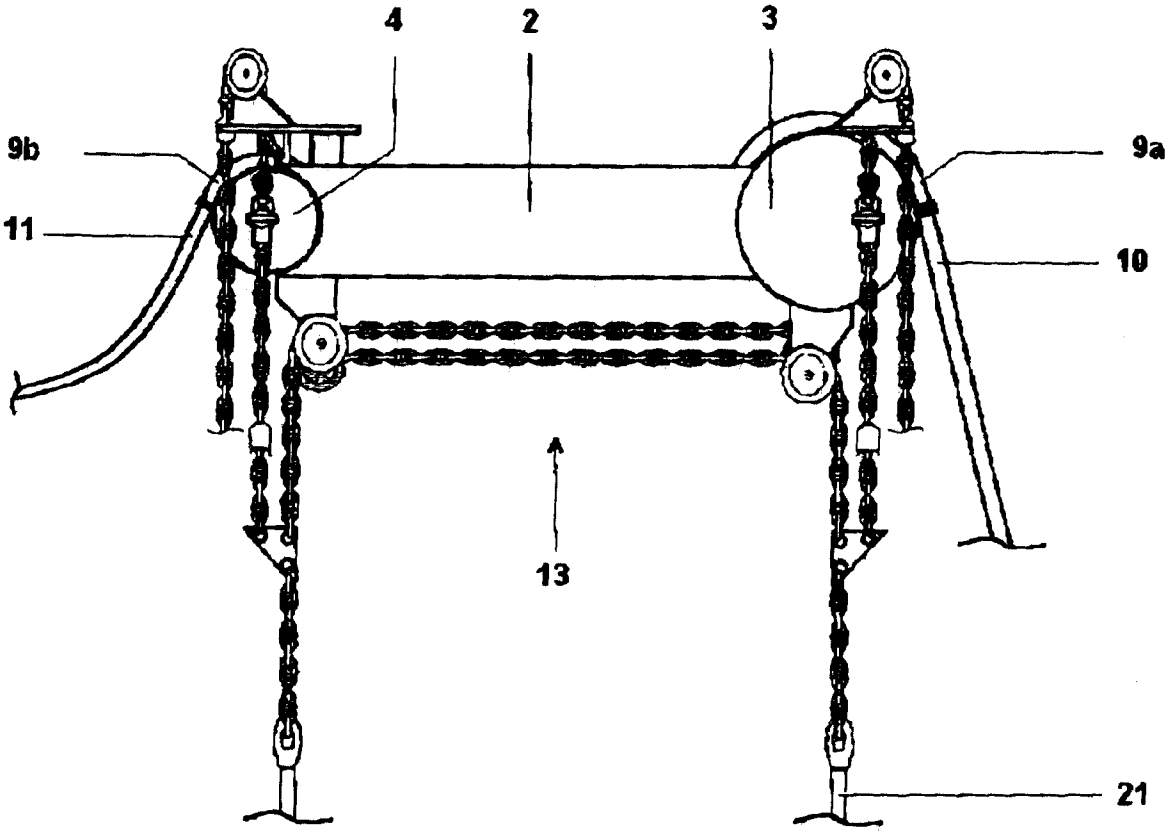
FIG. 5 illustrates a side view of the subsurface buoy of FIG. 1 with the tying and dynamically stabilizing system, the rigid tubes, the flexible tubes connected.

FIG. 5 illustrates a side view of a complete assembly of the subsurface buoy with the tying and dynamically stabilizing system 13 connected to the anchoring tendons 21 and to the rigid tubes 10 and flexible tubes 11, properly connected to supports 9*a* and 9*b*.

The scope of the present invention also comprises methods of installation of the subsurface buoy. Such methods will now be described, providing a better understanding of the function of each of the components of the present invention. The method of installation of the subsurface buoy comprises:

driving anchoring stakes (not illustrated) into the ocean floor at predetermined installation locations, connecting anchoring tendons 21 to driving anchoring stakes, and connecting coupling plates 19 to anchoring tendons 21;

connecting coupling plates 19 to the tension equalizing systems B;

feeding each one of the installation chains 15 through points in each one of the passive systems A;

connecting installation chains 15 to coupling plates 19 of the tension equalizing system B;

connecting a supply line to each one of the valves 7 on draining compartments 6 located inside cylindrical bodies 1, 2, 3, and 4 in order to supply compressed air thereto;

opening first valve 7 and second valve 8 from draining compartments 6 located inside cylindrical bodies 1, 2, 3, and 4 to allow flow of sea water therein;

lowering slowly the subsurface buoy until the end-of-travel device 18 comes in contact with the chain stopper 16;

injecting compressed air into each of the draining compartments 6 through each one of the first valves 7, to expel sea water therefrom and to cause a thrust towards the ocean surface;

removing the ballast until actuator links 17 contact the upper parts of chain stoppers 16, thus tensioning anchoring tendons 21 and installing the subsurface buoy at its depth of operation;

coupling flexible tubes 11 to supports 9*b* located on the cylindrical body at the bow side of the subsurface buoy; and coupling rigid tubes 10 to supports 9*a*, located on the cylindrical body at the stern side of the subsurface buoy.

The description presented above of the subsurface buoy, the tying and dynamically stabilizing system 13, and the method of installing the subsurface buoy, all objects of the disclosed invention, should be considered only exemplary embodiments. Any particular characteristics introduced in these examples should be understood only as being presented or described to facilitate an understanding of the invention to one of ordinary skill in the art. Therefore, these particular characteristics should not be considered as limiting the scope of the present invention, which scope is limited solely by the appended claims.

What is claimed is:

1. A subsurface buoy used in the production and transport of oil from an underwater well to a production unit at the ocean surface, the subsurface buoy comprising:

a first cylindrical body 1 and a second cylindrical body 2, longitudinally positioned parallel and separate from each other and having equal lengths and diameters;

a third cylindrical body 3, having a diameter larger than the diameter of said first and second cylindrical bodies 1 and 2, connected transversally to one of the extremities of the longitudinally positioned cylindrical bodies 1 and 2;

a fourth cylindrical body 4, having a length equal to the length of cylindrical body 3 and a diameter equal to the diameter of the longitudinally positioned cylindrical bodies 1 and 2, connected transversally to the other extremities of the longitudinally positioned cylindrical bodies 1 and 2;

a descending stabilizer 5 connected by its extremities to the longitudinally positioned cylindrical bodies 1 and 2, parallel and close to the fourth cylindrical body 4, configured to stabilize the positioning of the subsurface buoy during the descending and installation operations;

supports 9*a*, connected to the third cylindrical body 3, the extremities of which have a plurality of rigid tubes 10 connected thereto;

supports 9*b*, connected to the fourth cylindrical body 4, the extremities of which having a plurality of flexible tubes 11 connected thereto;

intermediary tubes 12, connected to supports 9*a* and 9*b* and aligned to the longitudinal cylindrical bodies 1 and 2, the intermediary tubes 12 interconnecting to the rigid tubes 10 and flexible tubes 11; and a tying and dynamically stabilizing system 13 configured to install the subsurface buoy at its depth of operation being connected to vertices formed by the union of cylindrical bodies 1, 2, 3, and 4.

2. The subsurface buoy according to claim 1 characterized by any one of the cylindrical bodies 1, 2, 3, or 4, forming the subsurface buoy, having in the interior thereof a plurality of draining compartments 6, each one of the plurality of draining compartments 6 having a first valve 7, for the introduction or removal of compressed air, connected to the top thereof and a second valve 8, for the introduction or removal of a ballast or seawater, connected to the bottom thereof.

3. The subsurface buoy of claim 1 further including a tying and dynamically stabilizing system 13 comprising:

a passive system A configured to install the subsurface buoy to its depth of operation; and a tension equalizing system B configured to maintain the tension equally distributed to anchoring tendons 21.

4. The tying and dynamically stabilizing system 13 for a subsurface buoy according to claim 3 wherein the passive system A comprises:

a pulley 14 connected to one of the upper extremities of one of the cylindrical bodies 3 or 4;

an installation chain 15, passing over pulley 14, used as a counterweight during the subsurface buoy's descending-operation to its depth of operation;

a chain stopper 16, through the interior of which the installation chain 15 passes, rigidly connected to the extremities of each one of the cylindrical bodies 3 and 4 and used to limit the travel of the installation chain 15 during the installation of the subsurface buoy;

an actuator link 17 for the chain stopper 16, interposed between links of the installation chain 15, having dimensions larger than the links of the installation chain 15, located above the chain stopper 16, and configured to interrupt the travel of the installation chain 15 during the installation of the subsurface buoy;

an end-of-travel device 18, interposed between links of the installation chain 15 and located below the chain stopper 16, configured to interrupt or suspend the travel of the installation chain 15 during the installation of the subsurface buoy;

a coupling plate 19, joined to one of the ends of installation chain 15, configured to connect the passive system A to the tension equalizing system B and to the anchoring tendon 21; and a lower connection 20 configured to install installation chain 15 to the anchoring tendon 21.

5. The tying and dynamically stabilizing system 13 for a subsurface buoy according to claim 3 wherein the tension equalizing system B comprises:

at least two major-base pulleys 22 connected to lower extremities of the cylindrical bodies 3 and 4, one major-base pulley 22 being connected to one extremity of cylindrical body 3 and the other major-base pulley 22 being connected to a diagonally opposed extremity of cylindrical body 4;

at least two minor-base pulleys 23 connected to the other lower extremities of the cylindrical bodies 3 and 4, one minor-base pulley 23 being connected to one extremity of cylindrical body 3 and the other minor-base pulley 23 being connected to a diagonally opposed extremity of cylindrical body 4;

a first supporting component 24, passing over the major-base pulleys 22 and being connected by its extremities to the diagonally opposed coupling plates 19 on the anchoring tendons 21; and a second supporting component 25, passing over the minor-base pulleys 23 and being connected by its extremities to the diagonally opposed coupling plates 19 on the anchoring tendons 21.

6. A method to install a subsurface buoy according to claim 1, said method comprising:

driving anchoring stakes into the ocean floor at predetermined installation locations, connecting anchoring tendons 21 to driving anchoring stakes, and connecting coupling plates 19 to anchoring tendons 21;

connecting coupling plates 19 to the tension equalizing systems B;

feeding each one of the installation chains 15 through each one of the points of the passive system A;

connecting installation chains 15 to coupling plates 19 of the tension equalizing system B;

connecting a supply line to each one of the valves 7 on draining compartments 6 located inside cylindrical bodies 1, 2, 3, and 4 in order to supply compressed air thereto;

opening first valve 7 and second valve 8 from draining compartments 6 located inside cylindrical bodies 1, 2, 3, and 4 to allow flow of sea water therein;

lowering slowly the subsurface buoy until the end-of-travel device 18 comes in contact with the chain stopper 16;

injecting compressed air into each of the draining compartments 6 through each one of the first valves 7, to expel sea water therefrom and to cause a thrust towards the ocean surface;

removing the ballast until actuator links 17 touch the upper parts of chain stoppers 16, thus tensioning anchoring tendons 21 and installing the subsurface buoy at its depth of operation;

coupling flexible tubes 11 to supports 9*b* located on the cylindrical body at the bow side of the subsurface buoy; and coupling rigid tubes 10 to supports 9*a* located on the cylindrical body at the stem side of the subsurface buoy.

* * * * *